US005622749A

United States Patent [19]

Rohringer et al.

[11] Patent Number: 5,622,749

[45] Date of Patent: Apr. 22, 1997

[54] FLUORESCENT WHITENING OF PAPER

[75] Inventors: Peter Rohringer, Schönenbuch, Switzerland; Thomas Ehlis, Freiburg, Germany; Josef Zelger, Riehen, Switzerland

[73] Assignee: Ciba-Geigy Corporation, Tarrytown, N.Y.

[21] Appl. No.: 650,263

[22] Filed: May 22, 1996

Related U.S. Application Data

[63] Continuation of Ser. No. 237,474, May 3, 1994, abandoned.

[30] Foreign Application Priority Data

May 8, 1993 [GB] United Kingdom ..... 9309510

[51] Int. Cl.[6] ..... B05D 5/06

[52] U.S. Cl. ..... 427/158; 162/158; 162/162; 252/301.21

[58] Field of Search ..... 162/158, 162; 427/157, 158; 252/301.21

[56] References Cited

U.S. PATENT DOCUMENTS

| | | | |
|---|---|---|---|
| 3,980,713 | 9/1976 | Matsunaga et al. | 260/612 R |
| 4,339,238 | 7/1982 | Pringel et al. | 8/527 |
| 4,364,845 | 12/1982 | Fringeli | 252/301.22 |
| 4,605,511 | 8/1986 | Fringeli | 252/301.21 |
| 4,888,128 | 12/1989 | Koll et al. | 252/301 |
| 5,234,617 | 8/1993 | Hunter et al. | 252/102 |
| 5,332,861 | 7/1994 | Guglielmetti | 562/87 |
| 5,437,818 | 8/1995 | Ehlis et al. | 252/301.21 |

FOREIGN PATENT DOCUMENTS

| | | |
|---|---|---|
| 823683 | 9/1969 | Canada . |
| 2099297 | 12/1993 | Canada . |
| 0577557 | 1/1994 | European Pat. Off. . |
| 0586346 | 3/1994 | European Pat. Off. . |
| 1247934 | 9/1971 | United Kingdom . |
| 2026054 | 1/1980 | United Kingdom . |
| 2026566 | 2/1980 | United Kingdom . |

*Primary Examiner*—Michael Lusignan
*Assistant Examiner*—Erma Cameron
*Attorney, Agent, or Firm*—Kevin T. Mansfield

[57] ABSTRACT

Accordingly, the present invention provides a method for the fluorescent whitening of paper comprising contacting the paper surface with a coating composition comprising a fluorescent whitening agent having the formula:

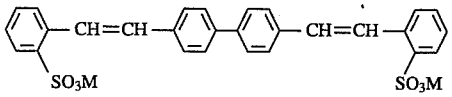

(1)

wherein M is hydrogen, an alkali metal, preferably sodium, ammonium or magnesium; or comprising contacting the paper in the size press with a combination of the compound of formula (1) and an auxiliary selected from a sequestering agent and a dispersing agent and/or an emulsifier.

32 Claims, No Drawings

FLUORESCENT WHITENING OF PAPER

This application is a continuation of application Ser. No. 08/237,474, filed May 3, 1994, now abandoned.

The present invention relates to a method for the fluorescent whitening of paper surfaces using a specific bis-stilbene whitening agent.

The stilbene class of stilbene fluorescent whitening agents is widely used in the paper industry but frequently suffers from inadequate bleed fastness to water when used in coating compositions.

In GB-A-1 247 934, there is described a wide range of bis-stilbene compounds, including the compounds of formula (1), as defined herein. This reference also describes the use the said compounds for the fluorescent whitening of paper, but only in the mass or in the size press, without the use of auxiliaries, and not for the surface coating of paper using a pigmented coating composition. Moreover, in GB-A-2 026 566 and GB-A-2 026 054, there is described the use of a wide range of stilbene fluorescent whitening agents containing a sulfo group, including the compounds of formula (1), in pigmented surface coatings for the surface coating of paper. However, it is an essential feature of these disclosed processes, that a solution of the said compounds, in specific solvents, namely oxyalkylated fatty amines (GB-A-2 026 566) or lactams (GB-A-2 026 054), must be used to prepare the respective fluorescent formulations employed in the production of the paper coating compositions.

Surprisingly, it has now been found that one specific bis-stilbene fluorescent whitening agent, when used in paper coatings, or in the size press with specific auxiliaries, provides a high fluorescent whitening effect at very low use levels, combined with a whole range of other properties which are desired for paper coating applications, such as improved bleed fastness to water. No special solvents are necessary for the formulation of the fluorescent whitening agent.

Accordingly, the present invention provides a method for the fluorescent whitening of paper comprising contacting the paper surface with a coating composition comprising a fluorescent whitening agent having the formula:

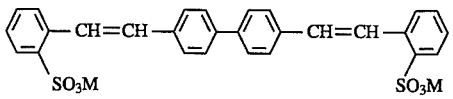

(1)

wherein M is hydrogen, an alkali metal, preferably lithium, sodium or potassium, ammonium or magnesium; or comprising contacting the paper in the size press with a combination of the compound of formula (1) and an auxiliary selected from a sequestering agent and a dispersing agent and/or an emulsifier.

In one preferred aspect, the present invention provides a method for the fluorescent whitening of a paper surface, comprising contacting the paper surface with a coating composition comprising a white pigment; a binder dispersion; optionally a water-soluble co-binder; and 0.01 to 2% by weight, based on the white pigment, of a fluorescent whitening agent having the formula (1).

As the white pigment component of the coating composition used according to the method of the present invention, there are preferred inorganic pigments, e.g., aluminium or magnesium silicates, such as China clay and kaolin and, further, barium sulfate, satin white, titanium dioxide, calcium carbonate (chalk) or talcum; as well as white organic pigments.

The coating compositions used according to the method of the present invention may contain, as binder, inter alia, plastics dispersions based on copolymers of butadiene/styrene, acryloninitrile/butadiene/styrene, acrylic acid esters, acrylic acid esters/styrene/acrylonitrile, ethylene/vinyl chloride and ethylene/vinyl acetate; or homopolymers, such as polyvinyl chloride, polyvinylidene chloride, polyethylene and polyvinyl acetate or polyurethanes. A preferred binder consists of styrene/butyl acrylate or styrene/butadiene/acrylic acid copolymers or styrene/butadiene rubbers. Other polymer latices are described, for example, in U.S. Pat. Nos. 3,265,654, 3,657,174, 3,547,899 and 3,240,740. The fluorescent brightener formulation is incorporated into these binders, for example, by means of melt emulsification.

The optional water-soluble co-binder may be, e.g., soya protein, casein, carboxymethylcellulose, natural or modified starch or, especially, polyvinyl alcohol. The preferred polyvinyl alcohol co-binder component may have a wide range of saponification levels and molecular weights; e.g. a saponification level ranging from 40 to 100; and an average molecular weight ranging from 10,000 to 100,000.

Recipes for such known coating compositions for paper are described, for example, in J. P. Casey "Pulp and Paper"; Chemistry and Chemical Technology, 2nd edition, Volume III, pages 1684–1649 and in "Pulp and Paper Manufacture", 2nd and 5th edition, Volume II, page 497 (McGraw-Hill).

The coating compositions used according to the method of the present invention preferably contain 10 to 70% by weight of a white pigment. The binder is preferably used in an amount which is sufficient to make the dry content of polymeric compound up to 1 to 30% by weight, preferably 5 to 25% by weight, of the white pigment. The amount of fluorescent brightener preparation used according to the invention is calculated so that the fluorescent brightener is preferably present in amounts of 0.01 to 1% by weight, more preferably 0.05 to 1% by weight, and especially 0.05 to 0.6% by weight, based on the white pigment.

The fluorescent whitening agent of formula (1), for use in the method of the present invention, is formulated as an aqueous liquid product, either as an aqueous dispersion or as an aqueous solution.

When formulated as an aqueous dispersion (slurry), the formulation preferably contains customary anionic or cationic and/or non-ionic emulsifiers and/or dispersing agents as the dispersing agents and/or emulsifiers, preferably in amounts of 2–20%, in particular 5–10%, based on the weight of fluorescent brightener.

Examples of anionic emulsifiers which may be mentioned are:

Carboxylic acids and their salts, such as the sodium, potassium or ammonium salts of lauric, stearic or oleic acid, acylation products of aminocarboxylic acids and their salts, for example the sodium salt of oleoylsarcoside, sulfates, such as fatty alcohol sulfates, for example lauryl sulfate and coconut sulfate, sulfates of hydroxy fatty acid esters, for example sulfated castor oil, and of fatty acid hydroxyalkylamides, for example sulfated coconut oil acid ethanolamide, and sulfates of partially esterified or etherified polyhydroxy compounds such as sulfated oleic acid monoglyceride or glycerol ether-sulfates, and furthermore sulfates of substituted polyglycol ethers, for example nonylphenyl polyglycol ether sulfate, sulfonates, such as primary and secondary alkylsulfonates, for example $C_{12}$–$C_{16}$paraffinsulfonic acids and sodium salts thereof, alkylsulfonates with acyl radicals bonded in amide or ester form, such as oleyl-methyl-tauride, and sulfonates of polycarboxylic acid esters, such as diisooctylsulfatosuccinic acid esters; and furthermore those with aromatic groups such as alkylbenzene, for example dodecylbenzene-, alkylnaphthalene-, such as dibutylnaphthlene, and alkylbenzimidazole, such as tetradecylbenzimidazole-sulfonates.

Examples of non-ionic emulsifiers which may be mentioned are:

Esters and ethers of polyalcohols, such as alkyl polyglycol ethers, for example lauryl alcohol or oleyl alcohol, polyethylene glycol ethers, acyl polyglycol ethers, such as oleic acid polyglycol ether, alkylaryl polyglycol ethers, such as the ethoxylation products of nonyl- and dodecylphenol, acylated amino-alkanol polyglycol ethers, and furthermore the known non-ionic surfactants which are derived from fatty amines, such as stearylamine, fatty acid amides or sugars and derivatives thereof.

The anionic dispersing agents are the customary dispersing agents, for example condensation products of aromatic sulfonic acids with formaldehyde or ligninsulfonates, for example the compounds obtainable under the description of sulfite waste liquor. However, naphthalenesulfonic acid/formaldehyde condensation products and especially ditolyether sulfonic acid/formaldehyde condensation products are particularly suitable. Mixtures of these dispersing agents can also be used.

Non-ionic dispersing agents which may be mentioned are the ethylene oxide adducts of the class of addition products of ethylene oxide on higher fatty acids, saturated or unsaturated fatty alcohols, mercaptans, fatty acid amides, fatty acid alkylolamides or fatty amines or alkylphenols or alkylthiophenols having at least 7 carbon atoms in the alkyl radical, and furthermore ricinoleic acid esters or hydroxyabietyl alcohol. Some of the ethylene oxide units can be replaced by other epoxides, for example styrene oxide or, in particular, propylene oxide.

Ethylene oxide adducts which may be mentioned specifically are:

a) reaction products of saturated and/or unsaturated fatty alcohols having 8 to 20 C atoms with 20 to 100 mol of ethylene oxide per mol of alcohol;

b) reaction products of alkylphenols having 7 to 12 C atoms in the alkyl radical with 5 to 20 mol, preferably 8 to 15 mol, of ethylene oxide per mol of phenolic hydroxyl group;

c) reaction products of saturated and/or unsaturated fatty amines having 8 to 20 C atoms with 5 to 20 mol of ethylene oxide per mol of amine;

d) reaction products of saturated and/or unsaturated fatty acids having 8 to 20 C atoms with 5 to 20 mol of ethylene oxide per mol of fatty acid;

e) a reaction product of 1 mol of ricinoleic acid ester and 15 mol of ethylene oxide;

f) a reaction product of 1 mol of hydroxyabietyl alcohol and 25 mol of ethylene oxide;

Mixtures of the ethylene oxide adducts according to a) to f) with one another can also be used. These mixtures are obtained by mixing individual reaction products or directly by ethoxylation of a mixture of the compounds on which the adducts are based. An ethoxylated nonylphenol is preferably used.

Possible cationic dispersing agents are, for example, quaternary fatty amine polyglycol ethers.

The fluorescent brightener formulation for use in producing the coating composition can, in addition, also contain 45–95% of water and optionally preservatives and foam suppressants.

When the fluorescent whitening agent of formula (1) is formulated as a concentrated slurry, viz. the content of the fluorescent whitener is 30 wt. % or higher, e.g. 60 wt. %, the aqueous formulation preferably contains It binder dispersion; an optional water-soluble co-binder; a stabiliser such as xanthan or carboxymethylcellulose; 0.01 to 1 wt. % of an anionic polysaccharide or polysaccharide mixture; 0.2 to 20 wt. % of a dispersing agent, each based on the total weight of the aqueous formulation; and optionally further additives.

The anionic polysaccharide used may be a modified polysaccharide such as those derived from cellulose, starch or from heteropolysaccharides, which may contain further monosaccharides, e.g. mannose or glucoronic acid, in the side-chains. Examples of anionic polysaccharides are sodium alginate, carboxymethylated guar, carboxymethylcellulose, carboxymethylstarches, carboxymethylated carob bean flour and, especially, xanthan, or mixtures of these polysaccharides.

The amount of polysaccharide used preferably ranges from 0.05 to 0.5, especially from 0.05 to 0.2 wt. %, based on the weight of the formulation.

Dispersing agents used may be anionic or nonionic and are preferably those indicated previously herein in relation to aqueous dispersions of the compounds of formula (1).

The content of the dispersing agent preferably ranges from 0.1 to 10 wt. %, especially from 0.2 to 5 wt. %, based on the total weight of the formulation.

Further additives which may be present in the aqueous slurry formulations include stabilising agents such as chloracetamide, triazine derivatives or benzoisothiazolines; Mg/Al silicates such as bentonite, montmorillonite, zeolites and highly-dispersed silicas; odour improvers; and antifreezes such as propylene glycol.

In some circumstances, such concentrated formulations can lead to problems of storage stability. One preferred method of combatting this problem is the use, as the fluorescent whitening agent of formula (1), of a hydrate of formula:

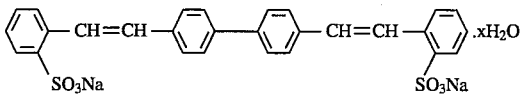

(2)

in which x is a number from 1 to 20, preferably 1,3,5,7,8, 9,10,11,12,13,14 or 15. Of particular interest are the hydrates of the platelet (p) crystal form having the formula (2) in which x is 10,11 or 12; hydrates of the rodlet (i- or j-) crystal form having the formula (2) in which x is a number between 7 and 12; mixtures of the i- and j- rodlet forms; or mixtures of any two or more of these crystal forms. Each of these crystal forms, or mixture thereof, has a specific X-ray diffraction diagram, as shown in the following Tables I to IV.

TABLE 1

Hydrate of 4,4'-bis-(2-sulfostyryl)-biphenyl-disodium salt in the platelet (p) crystal form

| d-Value(Å) | Intensity | d-Value(Å) | Intensity |
|---|---|---|---|
| 17.9 | weak | 3.77 | moderate |
| 13.8 | very weak | 3.65 | very strong |
| 9.3 | moderate | 3.58 | weak |
| 9.0 | very weak | 3.51 | strong |
| 7.7 | weak | 3.41 | very weak |
| 7.5 | very weak | 3.35 | weak |
| 7.3 | very weak | 3.21 | moderate |
| 6.9 | very weak | 3.19 | strong |
| 6.3 | weak | 3.14 | weak |
| 6.1 | strong | 3.07 | weak |
| 5.75 | very strong | 3.05 | weak |
| 5.60 | weak | 3.03 | weak |
| 5.35 | strong | 3.02 | very weak |

TABLE 1-continued

| Hydrate of 4,4'-bis-(2-sulfostyryl)-biphenyl-disodium salt in the platelet (p) crystal form | | | |
|---|---|---|---|
| d-Value(Å) | Intensity | d-Value(Å) | Intensity |
| 5.19 | very weak | 2.98 | weak |
| 5.04 | strong | 2.96 | very weak |
| 4.81 | strong | 2.90 | moderate |
| 4.67 | weak | 2.88 | weak |
| 4.55 | weak | 2.85 | very weak |
| 4.50 | very weak | 2.78 | very weak |
| 4.35 | moderate | 2.68 | weak |
| 4.12 | weak | 2.65 | moderate |
| 4.00 | very weak | 2.62 | weak |
| 3.90 | strong | 2.56 | very weak |
| 3.85 | strong | | |

TABLE 2

| Hydrate of 4,4'-bis-(2-sulfostyryl)-biphenyl-disodium salt in the rodlet(i) crystal form | | | |
|---|---|---|---|
| d-Value(Å) | Intensity | d-Value(Å) | Intensity |
| 18.6 | very weak | 4.49 | very weak |
| 12.1 | weak | 4.43 | weak |
| 9.3 | very weak | 4.37 | very weak |
| 9.0 | very weak | 4.25 | weak |
| 8.8 | very weak | 4.17 | weak |
| 7.2 | weak | 4.00 | very weak |
| 6.8 | weak | 3.95 | moderate |
| 6.7 | very strong | 3.93 | weak |
| 6.4 | moderate | 3.86 | moderate |
| 5.97 | moderate | 3.73 | weak |
| 5.78 | very weak | 3.68 | weak |
| 5.71 | weak | 3.63 | weak |
| 5.35 | weak | 3.59 | weak |
| 5.07 | moderate | 3.38 | very weak |
| 4.90 | very weak | 3.32 | weak |
| 4.84 | very strong | 3.30 | weak |
| 4.79 | strong | 3.19 | very weak |
| 4.53 | very weak | 3.00 | very weak |

TABLE 3

| Hydrate of 4,4'-bis-(2-sulfostyryl)-biphenyl-disodium salt in the rodlet(j) crystal form | | | |
|---|---|---|---|
| d-Value(Å) | Intensity | d-Value(Å) | Intensity |
| 19.8 | very weak | 4.73 | very strong |
| 11.1 | moderate | 4.62 | weak |
| 7.0 | weak | 4.60 | strong |
| 6.9 | very strong | 4.40 | weak |
| 6.4 | strong | 4.36 | very weak |
| 6.3 | weak | 4.25 | very weak |
| 6.0 | very weak | 4.20 | strong |
| 5.88 | weak | 4.11 | strong |
| 5.71 | weak | 3.88 | weak |
| 5.63 | moderate | 3.86 | moderate |
| 5.55 | weak | 3.75 | moderate |
| 5.29 | weak | 3.69 | moderate |
| 5.17 | very weak | 3.32 | very weak |
| 5.13 | weak | 3.25 | weak |
| 5.01 | strong | 3.11 | weak |
| 4.95 | moderate | 3.05 | weak |
| 4.86 | very weak | | |

TABLE 4

| Mixture of the Hydrates of 4,4'-bis-(2-sulfostyryl)-biphenyl-disodium salt in the rodlet(i- and j) crystal forms | | | |
|---|---|---|---|
| d-Value(Å) | Intensity | d-Value(Å) | Intensity |
| 19.7 | weak | 4.60 | strong |
| 18.7 | weak | 4.48 | very weak |
| 11.1 | moderate | 4.40 | weak |
| 7.0 | weak | 4.37 | very weak |
| 6.9 | strong | 4.26 | weak |
| 6.6 | very strong | 4.21 | strong |
| 6.4 | very strong | 4.12 | strong |
| 6.3 | weak | 3.87 | strong |
| 5.93 | (broad) mod. | 3.75 | moderate |
| 5.71 | moderate | 3.69 | moderate |
| 5.64 | moderate | 3,63 | very weak |
| 5.56 | weak | 3.59 | very weak |
| 5.30 | moderate | 3.37 | very weak |
| 5.13 | weak | 3.32 | weak |
| 5.06 | moderate | 3.30 | weak |
| 5.01 | very strong | 3.25 | weak |
| 4.96 | moderate | 3.18 | very weak |
| 4.84 | (broad) strg. | 3.12 | very weak |
| 4.79 | strong | 3.06 | very weak |
| 4.73 | strong | | |

With respect to aqueous solution formulations of the compounds of formula (1), the solvent used is preferably a combination of a polyethyleneglycol of molecular weight of 300 or above, and a glycol such as propyleneglycol. In such solution formulations, the amount of fluorescent whitener of formula (1) preferably ranges from 5 to 30, especially from 10 to 25 wt. %; the polyethyleneglycol preferably ranges from 10 to 50, especially from 15 to 40 wt. %; and the propyleneglycol from 10 to 35, especially from 15 to 30 wt. %, each based on the total weight of the aqueous formulation.

The coating composition used in the method according to the invention can be prepared by mixing the components in any desired sequence at temperature from 10° to 100° C., preferably 20° to 80° C. The components here also include the customary auxiliaries which can be added to regulate the rheological properties, such as viscosity or water retention capacity, of the coating compositions. Such auxiliaries are, for example, natural binders, such as starch, casein, protein or gelatin, cellulose ethers, such as carboxyalkylcellulose or hydroxyalkylcellulose, alginic acid, alginates, polyethylene oxide or polyethylene oxide alkyl ethers, copolymers of ethylene oxide and propylene oxide, polyvinyl alcohol, water-soluble condensation products of formaldehyde with urea or melamine, polyphosphates or polyacrylic acid salts.

The coating composition used according to the method of the present invention is used for coating paper or special papers such as cardboard or photographic papers.

The coating composition used according to the method of the invention can be applied to the substrate by any conventional process, for example with an air blade, a coating blade, a brush, a roller, a doctor blade or a rod, or in the size press, after which the coatings are dried at paper surface temperatures in the range from 70° to 200° C., preferably 90° to 130° C., to a residual moisture content of 3–8%, for example with infra-red driers and/or hot-air driers. Comparably high degrees of whiteness are thus achieved even at low drying temperatures.

By the use of the method according to the invention, the coatings obtained are distinguished by optimum distribution of the dispersion fluorescent brightener over the entire surface and by an increase in the level of whiteness thereby achieved, by a high fastness to light and to elevated temperature (e.g. stability for 24 hours at 60°–100° C.) and excellent bleed-fastness to water.

In a second preferred aspect, the present invention provides a method for the fluorescent whitening of a paper surface comprising contacting the paper in the size press with a solution or dispersion of 0.01 to 2% by weight, based on the weight of the paper, of the compound of formula (1) and 1 to 20% by weight, based on the weight of the solution or dispersion, of an auxiliary selected from one or more sequestering agents, preferably ethylenediaminetetraacetic acid, nitrilotriacetic acid, diethylenetriaminepentaacetic acid or a polyacrylic acid, and a dispersing agent and/or an emulsifier. The dispersing agent and/or emulsifier used may be any of those indicated herein in relation to paper coating compositions used according to the present invention, nonionic emulsifiers such as ethoxylated phenols, e.g. ethoxylated phenylphenol, being preferred.

Further, the aqueous fluorescent whitener formulations used according to the method of the present invention have the following valuable properties: low electrolyte content; low charge density; trouble-free incorporation into brush-on colours; no interaction with other additives; low interference by cationic auxiliaries; and excellent compatibility with and resistance to oxidising agents and peroxy-containing bleach residues.

The following Examples further illustrate the present invention. Parts and percentages shown therein are expressed by weight, unless indicated otherwise.

EXAMPLE 1

A) Dispersion of the Fluorescent Whitener 30 wt. % of the fluorescent whitener of the formula:

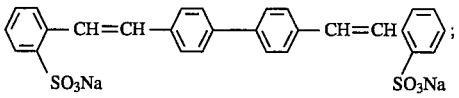

(101)

1.0 wt. % of the condensation product of a ditolylethersulfonic acid and formaldehyde;

0.2 wt. % of chloracetamide;

0.1 wt. % of an anionic polysaccharide; and deionised water to 100 wt. %, are blended and homogenised, with stirring, at 20° C.

B) Preparation of the Coating Composition

The following formulation is made up:

20 parts of a commercial clay (Clay SPS);

80 parts of a commercial calcium carbonate (Hydrocarb 90);

18 parts of a commercial 50% dispersion of a styrene/butyl rubber latex (Dow Latex 955);

0.5 part of a commercial polyvinyl alcohol (Mowiol 4–98);

0.5 part of carboxymethylcellulose (Finnfix 5);

0.3 part of a polycarboxylic acid dispersant(Polysalz S); and 0.5 part of a commercial 65% melamine/formaldehyde precondensate (Protex M3M).

Sufficient of the dispersion of Example 1(A) is then added to provide 0.2 part of the fluorescent whitener of formula (101). The content of the dry substance in the coating composition is adjusted to 60% and the pH is adjusted to 9.5 using NaOH.

C) Application of the Coating Composition to Paper

Commercial base paper of LWC (light weight coated) quality, having a weight per unit area of 39 g/m$^2$, a content of mechanical wood pulp of 50% and a whiteness of $R_{457}$=70.9 (Reflectance 457 nm), is coated in a Dow laboratory coater. The drying is effected with hot air at a temperature of 195°–200° C. until the moisture content is constant at about 7% by weight, under standard conditions. The coating weight, after acclimatisation, (23° C.,50% relative humidity), is 12.5 plus or minus 0.5 g/m$^2$.

The Ganz whiteness of the paper so coated is found to be 88.9 using a colorimeter (Zeiss RFC 3). The Ganz method is described in detail in the article "Whiteness Measurement" ISCC Conference on Fluorescence and the Colorimetry of Fluorescent Materials, Williamsburg, February, 1872, published in the Journal of Colour and Appearance, 1, No. 5 (1972).

When the procedure is repeated using a coating composition containing no fluorescent whitening agent of formula (101), the Ganz whiteness of paper so coated is only 37.7.

EXAMPLE 2

A) Dispersion of the Fluorescent Whitener of Example 1

The procedure described in step A) of Example 1) is repeated.

B) Preparation of the Coating Composition

The following formulation is made up:

70 parts of a commercial talc (Finntalk C10);

30 parts of a commercial calcium carbonate (Hydrocarb 90);

18 parts of a commercial 50% dispersion of a styrene/butyl rubber latex (Dow Latex 955);

0.5 part of a commercial polyvinyl alcohol (Mowiol 4–98);

0.5 part of carboxymethylcellulose (Finnfix 5);

0.3 part of a polycarboxylic acid dispersant(Polysalz S); and 0.5 part of a commercial 65% melamine/formaldehyde precondensate (Protex M3M).

Sufficient of the dispersion of Example 1(A) is then added to provide 0.2 part of the fluorescent whitener of formula (101). The content of the dry substance in the coating composition is adjusted to 60% and the pH is adjusted to 9.5 using NaOH.

C) Application of the Coating Composition to Paper

The procedure according to step C) of Example 1) is repeated.

The Ganz whiteness of the paper so coated is 92.8. When the procedure is repeated using a coating composition containing no fluorescent whitening agent of formula (101), the Ganz whiteness of the paper so coated is only 40.1.

EXAMPLE 3

A) Dispersion of the Fluorescent Whitener of Example 1

The procedure of step A) of Example 1 is repeated.

B) Preparation of the Coating Composition

The following formulation is made up:

80 parts of a commercial clay (Clay SPS);

20 parts of a commercial calcium carbonate (Hydrocarb 90);

10 parts of a commercial 50% dispersion of a styrene/butyl rubber latex (Dow Latex 955);

0.5 part of a commercial polyvinyl alcohol (Mowiol 4–98);

0.3 part of a polycarboxylic acid dispersant(Polysalz S); and 0.5 part of a commercial 65% melamine/formaldehyde precondensate (Protex M3M).

Sufficient of the dispersion of Example 1(A) is then added to provide 0.2 part of the fluorescent whitener of formula (101). The content of the dry substance in the coating composition is adjusted to 60% and the pH is adjusted to 9.5 using NaOH.

C) Application of the Coating Composition to Paper

The procedure of step C) of Example 1 is repeated.

The Ganz whiteness of the paper so coated is 69.5 compared a Ganz whiteness of 37.2 for paper coated with a coating composition containing no fluorescent whitener of formula (101).

EXAMPLE 4

A) Dispersion of the Fluorescent Whitener of Example 1

The procedure of step A) of Example 1 is repeated.

B) Preparation of the Coating Composition

The following formulation is made up:

80 parts of a commercial clay (Clay SPS);
20 parts of a commercial calcium carbonate (Hydrocarb 90);
10 parts of a commercial 50% dispersion of a styrene/butyl rubber latex (Dow Latex 955);
0.3 part of a polycarboxylic acid dispersant(Polysalz S); and
0.2 part of a commercial polyvinyl alcohol (Mowiol 4–88);

Sufficient of the dispersion of Example 1(A) is then added to provide 0.2 part of the fluorescent whitener of formula (101). The content of the dry substance in the coating composition is adjusted to 60% and the pH is adjusted to 9.5 using NaOH.

C) Application of the Coating Composition to Paper

The procedure of step C) of Example 1 is repeated.

The Ganz whiteness of the paper so coated is 60.7 compared a Ganz whiteness of 29.7 for paper coated with a coating composition containing no fluorescent whitener of formula (101).

EXAMPLE 5

The following aqueous solution formulation of the compound of formula (1) is made up:

20 parts of the compound of formula (101);
25 parts of polyethylene glycol having a molecular weight of 600 (PEG 600);
30 parts of propylene glycol; and
0.3 part of a polycarboxylic acid dispersant(Polysalz S).

The formulation is stable for at least one week at 0° C. and at 20° C.

When used to prepare a coating composition as in step B) of any of Examples 1 to 5, and the resulting coating composition is then used to coat paper as in step C) of Example 1, excellent Ganz whiteness ratings of the paper so coated are obtained.

EXAMPLE 6

The following aqueous solution formulation of the compound of formula (1) is made up:

20 parts of the compound of formula (101);
25 parts of polyethylene glycol having a molecular weight of 600 (PEG 600);and
35 parts of propylene glycol.

The formulation is stable for at least one week at 0° C. and at 20° C.

When used to prepare a coating composition as in step B) of any of Examples 1 to 5, and the resulting coating composition is then used to coat paper as in step C) of Example 1, excellent Ganz whiteness ratings of the paper so coated are obtained.

EXAMPLE 7

The following aqueous solution formulation of the compound of formula (1) is made up:

20 parts of the compound of formula (101);
25 parts of polyethylene glycol having a molecular weight of 1500 (PEG 1500); and
30 parts of propylene glycol.

The formulation is stable for at least one week at 0° C. and at 20° C.

When used to prepare a coating composition as in step B) of any of Examples 1 to 5, and the resulting coating composition is then used to coat paper as in step C) of Example 1, excellent Ganz whiteness ratings of the paper so coated are obtained.

EXAMPLE 8

A) Dissolution of the Fluorescent Whitener

The following solution formulation of the compound of formula (1) is made up:

10 parts of the compound of formula (101);
12.5 parts of polyethylene glycol having a molecular weight of 1500 (PEG 1500);
25 parts of propylene glycol; and
1.6 parts of nitriloacefic acid.

The formulation is stable for at least one week at 20° C.

B) Application of the Fluorescent Whitener Solution to Paper

A commercial wood-free raw paper is used having a weight per unit area of 90 g/m$^2$ and which has been mass-sized with rosin size and alum at pH 5.0. It is impregnated in the size press with an aqueous solution containing anionic starch (8% Perfectamyl A 4692) and the solution of Example 9(A) in water of 10° German Hardness. The liquor uptake is 35% and the use concentration of the compound of formula (101) is 6 g/l, as active substance.

The Ganz whiteness of the paper so treated is 214, whereas paper treated in an identical manner with a slurry according to Example 1(A) has a Ganz whiteness of only 170.

EXAMPLE 9

A) Dissolution of the Fluorescent Whitener

The following solution formulation of the compound of formula (1) is made up:

10 parts of the compound of formula (101);
12.5 parts of polyethylene glycol having a molecular weight of 1500 (PEG 1500);
25 parts of propylene glycol; and
4.5 parts of polyacrylic acid [Acrysol LMW 20 (50% solution)].

The formulation is stable for at least one week at 20° C.

B) Application of the Fluorescent Whitener Solution to Paper

The procedure described in part B) of Example 8 is repeated. The paper so obtained has a Ganz Whiteness of 213.

EXAMPLE 10

A) Dissolution of the Fluorescent Whitener

The following solution formulation of the compound of formula (1) is made up:

20 parts of the compound of formula (101);
18 parts of polyethylene glycol having a molecular weight of 300 (PEG 300);
15 parts of ethylene glycol;
11 parts of urea; and
10 parts of ethoxylated phenylphenol.

B) Application of the Fluorescent Whitener Solution to Paper

The procedure described in part B) of Example 8 is repeated. The paper so obtained has a Ganz Whiteness of 216.

The results in Examples 8 to 10 demonstrate the improved results which are obtained when the fluorescent whitener solution applied in the size press contains one or more specific auxiliaries such as a sequestering agent, e.g., nitriloacetic acid, a dispersing agent/emulsifier such as a polyacrylic acid.

EXAMPLE 11

A) Dissolution of Various Salts of the Fluorescent Whitener

The the disodium salt of the compound of formula (101) is dissolved in sufficient deionised hot water to achieve a clear solution.

In addition, the same procedure is used to produce respective solutions of:

a) the dipotassium salt of the compound of formula (101);
b) the diammonium salt of the compound of formula (101);
c) the dilithium salt of the compound of formula (101); and
d) the dimagnesium salt of the compound of formula (101);

B) Preparation of the Coating Composition

The respective salt solutions obtained in Example 11(A) are to prepare respective coating compositions using the procedure described in Example 1B).

C) Application of the Coating Composition to Paper

Commercial base paper of LWC (light weight coated) quality, having a weight per unit area of 39 g/m$^2$, a content of mechanical wood pulp of 50% is coated in a Dow laboratory coater at a blade pressure of 0.48 bar, at an application consistency of 60% at pH 9.2.

The drying is effected at 195° to 200° C. until the moisture content is constant at about 7% by weight, under standard conditions. The coating weight, after acclimatisation (23° C., 50% relative humidity), is 12.6±1.4 g/m$^2$.

The Ganz Whiteness of each coated paper is determined using a Datacolor measuring device. The Ganz Whiteness of a control paper coated with a coating composition containing no salt of the compound of formula (101) is 27.5.

The results are set out in the following Table:

TABLE

| | % FWA used (based on pigment***) | | | | |
|---|---|---|---|---|---|
| Salt of Compound (101) | 0.05 | 0.10 | 0.20 | 0.40 | 0.80 |
| disodium | 53.1 | 67.5 | 74.4 | 82.1 | 77.0 |
| dipotassium | 57.1 | 71.4 | 80.0 | 76.9 | 62.1 |
| diammonium | 57.7 | 67.6 | 80.7 | 79.1 | 65.5 |
| dilithium* | 64.1 | 75.6 | 83.6 | 87.3 | 78.0 |
| dimagnesium** | 50.1 | 59.6 | 69.6 | 76.5 | 74.7 |

FWA denotes fluorescent whitening agent.
*The coating weight is 11.6 ± 0.4 g/m$^2$ and the Ganz Whiteness of the control base paper is 31.3.
**The coating weight is 15.4 ± 2.2 g/m$^2$ and the Ganz Whiteness of the control base paper is 28.8.
***The white clay and calcium carbonate pigments in the coating composition.

EXAMPLE 12

A) Dissolution of Various Salts of the Fluorescent Whitener

The procedure described in Example 12(A) is repeated.

B) Preparation of the Coating Composition

The procedure described in Example 12(B) is used to prepare respective coating compositions containing the disodium-, dipotassium-, diammonium-, dilithium- or dimagnesium salt of the compound of formula (101).

C) Application of the Coating Composition to Paper

Commercial base paper which is free of mechanical fibre and is industrially pre-coated, having a weight per unit area of 77 g/m$^2$, is coated in a Dow laboratory coater at a blade pressure of 0.48 bar, at an application consistency of 60% at pH 9.2.

The drying is effected at 195° to 200° C. until the moisture content is constant at about 7% by weight, under standard conditions. The coating weight, after acclimatisation (23° C., 50% relative humidity), is 9.7±2.1 g/m$^2$.

The Ganz Whiteness of each coated paper is determined using a Datacolor measuring device. The Ganz Whiteness of a control paper coated with a coating composition containing no salt of the compound of formula (101 ) is 105.0.

The results are set out in the following Table:

TABLE

| | % FWA used (based on pigment***) | | | | |
|---|---|---|---|---|---|
| Salt of Compound (101) | 0.05 | 0.10 | 0.20 | 0.40 | 0.80 |
| disodium | 125.7 | 136.0 | 142.5 | 142.4 | 126.3 |
| dipotassium | 131.1 | 138.6 | 140.1 | 125.7 | 104.9 |
| diammonium | 130.9 | 139.2 | 138.9 | 130.1 | 100.6 |
| dilithium* | 134.1 | 141.9 | 145.2 | 138.7 | 113.2 |
| dimagnesium** | 123.7 | 132.3 | 136.4 | 139.5 | 124.6 |

FWA denotes fluorescent whitening agent.
*The coating weight is 8.0 ± 0.3 g/m$^2$ and the Ganz Whiteness of the control base paper is 103.9.
**The coating weight is 12.4 ± 2.8 g/m$^2$ and the Ganz Whiteness of the control base paper is 103.9.
***The white clay and calcium carbonate pigments in the coating composition.

We claim:

1. A method for the fluorescent whitening of paper a) comprising contacting the paper surface with an aqueous coating composition comprising a white pigment; a binder dispersion; optionally a water-soluble co-binder; and 0.01 to 2% by weight, based on the weight of the pigment, of a fluorescent whitening agent having the formula:

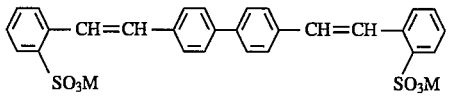

(1)

wherein M is hydrogen, an alkali metal, ammonium or magnesium; or b) comprising contacting the paper in a size press with an aqueous combination of the compound of formula (1) and at least one auxiliary selected from a sequestering agent, a dispersing agent and an emulsifier.

2. A method according to claim 1 wherein the alkali metal M is lithium, sodium or potassium.

3. A method according to claim 1 wherein the pigment is an aluminium or magnesium silicate, barium sulfate, satin white, titanium dioxide, calcium carbonate or talcum; or an organic pigment.

4. A method according to claim 3 wherein the aluminium silicate is China clay or kaolin.

5. A method according to claim 1 wherein the binder is a styrene/butyl acrylate or styrene/butadiene/acrylic acid copolymer or a styrene/butadiene or polyvinylacetate rubber.

6. A method according to claim 1 wherein the co-binder is a polyvinyl alcohol, either alone or in combination with one or more other water-soluble co-binders.

7. A method according to claim 6 wherein the co-binder is a polyvinyl alcohol having a saponification level ranging from 40 to 100 and an average molecular weight ranging from 10,000 to 100,000.

8. A method according to claim 1 wherein the coating composition contains 10 to 70% by weight of the pigment.

9. A method according to claim 1 wherein the binder is used in an amount to make the dry content of binder up to 1 to 30% by weight, based on pigment.

10. A method according to claim 9 wherein the binder is used in an amount to make the dry content of binder up to 5 to 25% by weight, based on pigment.

11. A method according to claim 1 wherein the amount of fluorescent whitener is calculated so that the fluorescent whitener is present in the coating composition in an amount of 0.05 to 1% by weight, based on the pigment.

12. A method according to claim 11 wherein the amount of fluorescent whitener is calculated so that the fluorescent whitener is present in the coating composition in an amount of 0.05 to 0.6% by weight, based on the pigment.

13. A method according to claim 1 wherein the fluorescent whitener is formulated as an aqueous dispersion and contains at least one emulsifier or dispersing agent, wherein said emulsifier or dispersing agent is anionic, cationic, non-ionic or a mixture thereof.

14. A method according to claim 13 wherein the amount of the emulsifier and/or dispersing agent is 2 to 20% by weight, based on the fluorescent whitener.

15. A method according to claim 13 wherein the fluorescent whitener formulation contains 45 to 95% by weight of water and optionally preservatives and foam supressants.

16. A method according to claim 13 wherein the fluorescent whitener of formula (1) is formulated as a dispersion containing 30 wt. % or higher of fluorescent whitener, and the formulation also contains 0.01 to 1 wt. % of an anionic polysaccharide; 0.2 to 20 wt. % of a dispersing agent, each based on the total weight of the aqueous formulation; and optionally further additives.

17. A method according to claim 16 wherein the polysaccharide is xanthan.

18. A method according to claim 16 wherein the further additives are stabilising agents; Mg or Al silicates or a mixture thereof; odour improvers; or antifreezes.

19. A method according to claim 1 wherein the fluorescent whitener of formula (1) used is a hydrate of formula:

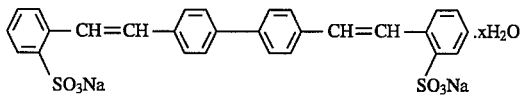

(2)

in which x is a number from 1 to 20.

20. A method according to claim 19 wherein x is 1,3,5, 7,8,9,10,11,12,13,14 or 15.

21. A method according to claim 20 wherein x is 10,11 or 12 and the hydrate is in the platelet (p) crystal form.

22. A method according to claim 20 wherein x is a number between 7 and 12 and the hydrate is in the rodlet (i- or j-) crystal form, or a mixture of these forms.

23. A method according to claim 1 wherein the fluorescent whitener of formula (1) is formulated as an aqueous solution and the solvent used is a combination of a polyethyleneglycol of molecular weight of 600 or higher and propyleneglycol.

24. A method according to claim 23 wherein the amount of the fluorescent whitener of formula (1) in the formulation ranges from 5 to 30 wt. %; the polyethyleneglycol ranges from 10 to 50 wt. %; and the propyleneglycol ranges from 10 to 35 wt. %; each based on the total weight of the aqueous formulation.

25. A method according to claim 24 wherein the amount of the fluorescent whitener of formula (1) in the formulation ranges from 10 to 25 wt. %; the polyethyleneglycol ranges from 15 to 40 wt. %; and the propyleneglycol ranges from 15 to 30 wt. %; each based on the total weight of the aqueous formulation.

26. A method according to claim 1 wherein the coating composition contains one or more auxiliaries which function to regulate the rheological properties of the coating composition.

27. A method according to claim 26 wherein the auxiliary is carboxymethylcellulose and/or polyvinyl alcohol.

28. A method according to claim 1 wherein the surface which is whitened is of paper, cardboard or photopaper.

29. A method for the fluorescent whitening of paper according to claim 1 comprising contacting the paper in a size press with a solution or dispersion of 0.01 to 2% by weight, based on the weight of the paper, of the compound of formula (1) and 1 to 20% by weight, based on the weight of the solution or dispersion, of an auxiliary selected from a sequestering agent and a dispersing agent, a sequestering agent and an emulsifier or a sequestering agent, a dispersing agent and an emulsifier.

30. A method according to claim 29 wherein the sequestering agent is one or more of ethylenediaminetetraacetic acid, nitrilotriacetic acid, diethylenetriaminepentaacetic acid and a polyacrylic acid.

31. A method according to claim 29 wherein the dispersing agent or emulsifier is a nonionic.

32. A method according to claim 31 wherein the nonionic dispersing agent or emulsifier is an ethoxylated phenol.

* * * * *